US005683473A

United States Patent [19]

Jureller et al.

[11] Patent Number: 5,683,473

[45] Date of Patent: *Nov. 4, 1997

[54] METHOD OF DRY CLEANING FABRICS USING DENSIFIED LIQUID CARBON DIOXIDE

[75] Inventors: Sharon Harriott Jureller, Haworth; Judith Lynne Kerschner, Fairlawn, both of N.J.; Rosemarie Harris, Yonkers, N.Y.

[73] Assignee: Lever Brothers Company, Division of Conopco, Inc., New York, N.Y.

[ * ] Notice: The term of this patent shall not extend beyond the expiration date of Pat. No. 5,676,705.

[21] Appl. No.: 700,265

[22] Filed: Aug. 20, 1996

Related U.S. Application Data

[63] Continuation-in-part of Ser. No. 399,317, Mar. 6, 1995.

[51] Int. Cl.[6] ..... D06L 1/00

[52] U.S. Cl. ..... 8/142; 510/285; 510/288; 510/289; 510/290; 510/291

[58] Field of Search ..... 8/142, 137, 139, 8/111; 510/285, 289, 288, 290, 291

[56] References Cited

U.S. PATENT DOCUMENTS

| | | |
|---|---|---|
| 3,686,125 | 8/1972 | Miller . |
| 3,776,693 | 12/1973 | Smith et al. . |
| 4,012,194 | 3/1977 | Maffei . |
| 4,104,409 | 8/1978 | Vitzthum et al. . |
| 4,123,559 | 10/1978 | Vitzthum et al. . |
| 5,152,933 | 10/1992 | Holland ..... 510/340 |
| 5,316,591 | 5/1994 | Chao et al. . |
| 5,339,844 | 8/1994 | Stanford, Jr. et al. . |
| 5,456,759 | 10/1995 | Stanford, Jr. et al. . |
| 5,467,492 | 11/1995 | Chao et al. . |

FOREIGN PATENT DOCUMENTS

| | | |
|---|---|---|
| 518 653 | 12/1992 | European Pat. Off. . |
| 530949 | 3/1993 | European Pat. Off. . |
| 3904514 | 8/1990 | Germany . |

OTHER PUBLICATIONS

Consani, K.A. "Observations on the Solubility of Surfactants and Related Molecules in Carbon Dioxide at 50°C" Journal of Supercritical Fluids, 1990, pp. 3, 51–65; (Month Unknown).

McFann, G. "Formation and Phase Behavior of Reverse Micelles and Microemulsions in Supercritical Fluid Ethane, Propane and Carbon Dioxide", Chapter 5, Dissertation Univ. of Texas, Austin 1993, pp. 216–306; (Month Unknown).

Grant, D.J. W. et al., "Solubility Behavior of Organic Compounds", Techniques of Chemistry Series, J. Wiley and Sons, (NY 1990) describing Hildebrand equation discussed on p. 7 of the specification; (Month Unknown).

Attwood, D. "Surfactant Systems Their Chemistry, Pharmacy and Biol.", 1983, pp. 472–474; discussed on p. 30; (Month Unknown).

Biocatalysts for Industry, pp. 219–237, 1991 (Plenum) ed by J. Dordick –Biocatalysts in Supercritical Fluids;74 (1993), pp. 151, 152; (Month Unknown).

Gerbert, B. et al., Supercritical $CO_2$ as Replacement for Perchloroethylene, Translation of Melliand Textilberichte Feb. 1993.

Hoefling, T. et al., "The Incorporation of a Fluorinated Ether Functionality into a Polymer or Surfactant to Enhance $CO_2$–Solubility" The Journal of Supercritical Fluids, U.S. #4 (1992), vol. 51, pp. 237–241; (Month Unknown).

Newman, D.A., et al., "Phase Behavior of Fluoroether–Functional Amphiphiles in Supercritical Carbon Dioxide", The Journal of Supercritical Fluids, (1993), vol. 6, pp. 205–210; (Month Unknown).

Hardman et al., "Encyclopedia of Polymer Science and Engineering", Second Edition, vol. 15, pp. 204–308; (Date Unknown).

*Primary Examiner*—Alan D. Diamond
*Attorney, Agent, or Firm*—A. Kate Huffman

[57] ABSTRACT

A method of dry cleaning fabrics using a dry cleaning system is described. The system comprises densified carbon dioxide, preferably in a liquid phase, and a selected surfactant which is soluble in the densified $CO_2$. The surfactant has a polysiloxane, a branched polyalkylene oxide or a halocarbon group which is a functional $CO_2$-philic moiety connected to a $CO_2$-phobic functional moiety. The surfactant either exhibits an HLB of less than 15 or has a ratio of siloxyl to substituted siloxyl groups of greater than 0.5:1.

10 Claims, 1 Drawing Sheet

METHOD OF DRY CLEANING FABRICS USING DENSIFIED LIQUID CARBON DIOXIDE

RELATED APPLICATION

This application is a continuation-in-part of U.S. Ser. No. 08/399,317 filed Mar. 6, 1995.

FIELD OF THE INVENTION

The invention pertains to a method of dry cleaning fabrics utilizing a system combining densified carbon dioxide and a surfactant adjunct.

BACKGROUND OF THE INVENTION

Densified, particularly supercritical fluid, carbon dioxide has been suggested as an alternative to halo-carbon solvents used in conventional dry cleaning. For example, a dry cleaning system in which chilled liquid carbon dioxide is used to extract soils from fabrics is described in U.S. Pat. No. 4,012,194 issued to Maffei on Mar. 15, 1977.

Densified carbon dioxide provides a nontoxic, inexpensive, recyclable and environmentally acceptable solvent to remove soils in the dry cleaning process. The supercritical fluid carbon dioxide has been shown to be effective in removing nonpolar stains such as motor oil, when combined with a viscous cleaning solvent, particularly mineral oil or petrolatum as described in U.S. Ser. No. 715,299, filed Jun. 14, 1991, assigned to The Clorox Company and corresponding to EP 518,653. Supercritical fluid carbon dioxide has been combined with other components, such as a source of hydrogen peroxide and an organic bleach activator as described in U.S. Ser. No. 754,809, filed Sep. 4, 1991 and owned by The Clorox Company, corresponding to EP 530,949.

A system of drycleaning fabrics using liquid carbon dioxide under stirring and optionally including conventional detergent surfactants and solvents is described in U.S. Pat. No. 5,467,492 corresponding to JP 08052297 owned by Hughes Aircraft Co.

The solvent power of densified carbon dioxide is low relative to ordinary liquid solvents and the carbon dioxide solvent alone is less effective on hydrophilic stains such as grape juice, coffee and tea and on compound hydrophobic stains such as lipstick and red candle wax, unless selected surfactants and solvent modifiers are added.

A cleaning system combining particular anionic or nonionic surface active agents with supercritical fluid $CO_2$ is described in DE 39 04 514 A1 published Aug. 23, 1990. These anionic and nonionic agents, such as alkylenebenzene sulfates and sulfonates, ethoxylated alkylene phenols and ethoxylated fatty alcohols, were particularly effective when combined with a relatively large amount of water (greater than or equal to 4%). The patented system appears to combine the detergency mechanism of conventional agents with the solvent power of supercritical fluid carbon dioxide.

It has been observed that most commercially available surfactants have little solubility in supercritical fluid carbon dioxide as described in Consani, K. A., *J. Sup. Fluids,* 1990 (3), pages 51–65. Moreover, it has been observed that surfactants soluble in supercritical fluid carbon dioxide become insoluble upon the addition of water. No evidence for the formation of water-containing reversed micelles with the surfactants was found. Consani supra.

Thus, the dry cleaning systems known in the art have merely combined cleaning agents with various viscosities and polarities with supercritical fluid $CO_2$ generally with high amounts of water as a cosolvent. The actives clean soils as in conventional washing without any synergistic effect with the $CO_2$ solvent.

The formation of water-containing reversed micelles is believed to be critical for the solubility and removal of hydrophilic stains. Studies of the interaction of surfactants in supercritical carbon dioxide with water, cosurfactants and cosolvents led to the conclusion that most commercially available surfactants are not designed for the formation of reversed micelles in supercritical carbon dioxide as described in McFann, G., Dissertation, University of Texas at Austin, pp. 216–306, 1993.

Therefore, the problem of developing an effective dry cleaning system utilizing densified carbon dioxide, particularly in liquid form, to clean a variety of consumer soils on fabrics has remained unaddressed until the present invention.

SUMMARY OF THE INVENTION

It is therefore an object of the present invention to provide a dry cleaning system utilizing an environmentally safe, nonpolar solvent such as densified carbon dioxide, particularly in a liquid form, which effectively removes a variety of soils from fabrics.

Another object is the design of effective surfactants for use in densified carbon dioxide in a liquid phase.

Another object of the invention is to provide a dry cleaning system which may include a solvent, a surfactant, an enzyme or a bleach in selected combinations for the total cleaning of fabrics using densified carbon dioxide that gives results equivalent to the cleaning demonstrated by conventional dry cleaning solvents.

In a first aspect of the invention, a method for dry cleaning a variety of soiled fabrics is provided wherein a selected surfactant and optionally a modifier, an enzyme, bleaching agent or mixtures thereof are combined. The stained cloth is then contacted with the mixture. Densified carbon dioxide is introduced into a cleaning vessel which is then pressurized to a pressure in the range of about 14.7 psi to about 10,000 psi and adjusted to a temperature range of from about −78.5° C. up to about 20° C. so that the densified carbon dioxide is in a liquid phase. Optionally fresh densified carbon dioxide may be used to flush the cleaning vessel.

In another aspect of the present invention, the dry cleaning system used for cleaning a variety of soiled fabrics comprises densified carbon dioxide and about 0.001% to about 5% of a surfactant in the carbon dioxide. The surfactant has a densified $CO_2$-philic functional moiety connected to a densified $CO_2$-phobic functional moiety. Preferred $CO_2$-philic moieties of the surfactant include halocarbons such as fluorocarbons, chlorocarbons and mixed fluorochlorocarbons, polysiloxanes, and branched polyalkylene oxides. The $CO_2$-phobic groups for the surfactant contain preferably polyalkylene oxides, carboxylates, $C_{1-30}$ alkylene sulfonates, carbohydrates, glycerates, phosphates, sulfates and $C_{1-30}$ hydrocarbons.

The dry cleaning system may also be designed to include a modifier, such as water, or an organic solvent up to only about 10% by volume, preferably about 0.001 to about 5 wt. %; enzymes up to about 10 wt. % and a bleaching agent such as a peracid.

DETAILED DESCRIPTION OF PREFERRED EMBODIMENTS

Figure 1:
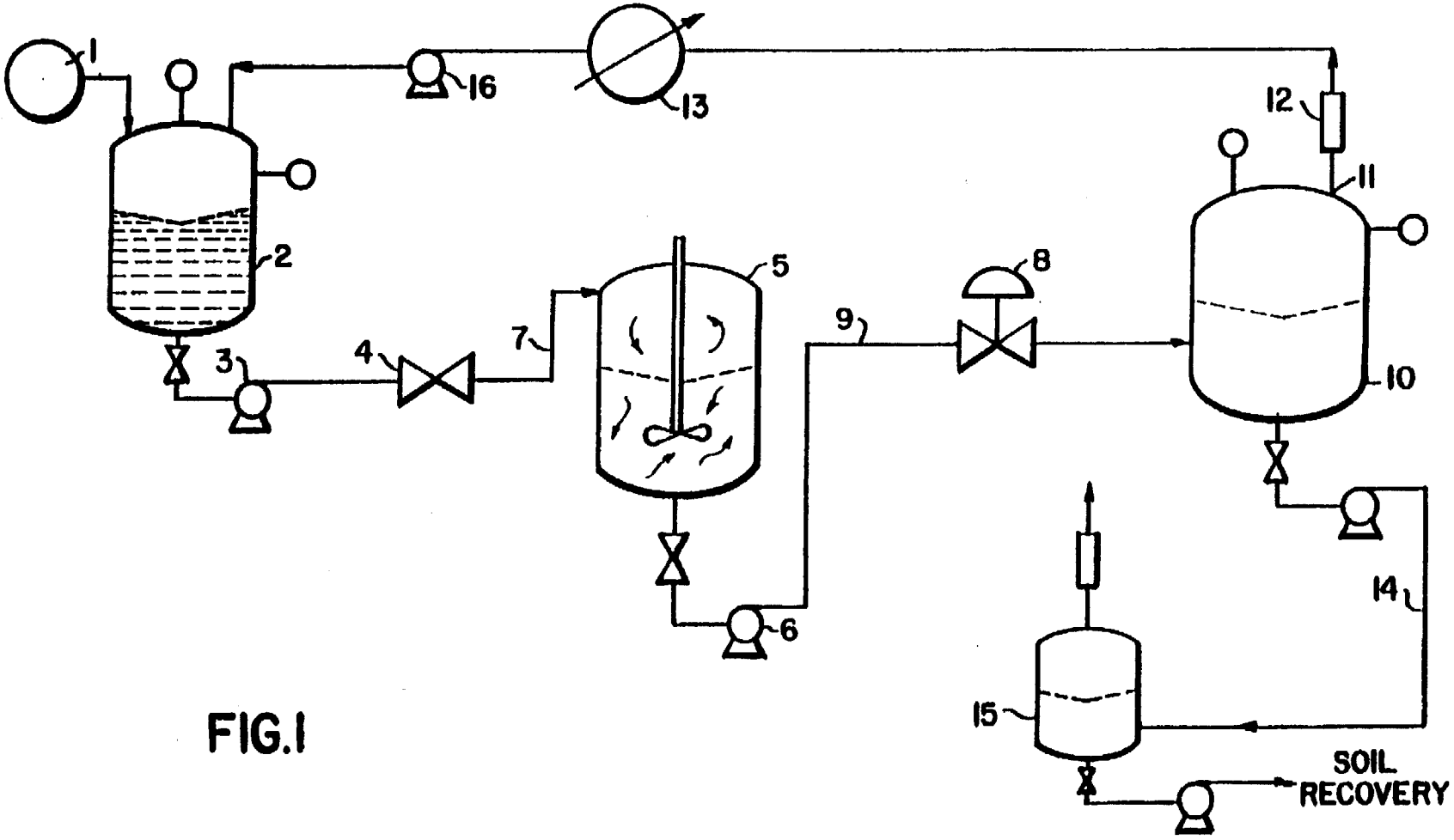
FIG. 1 is a diagrammatic flow chart of the densified carbon dioxide dry cleaning process according to the invention.

The invention provides a dry cleaning system which replaces conventional solvents with densified carbon dioxide in combination with selected cleaning surfactants.

Optionally, modifiers, enzymes, bleaching agents and mixtures thereof are combined with the solvent and surfactant to provide a total cleaning system.

For purposes of the invention, the following definitions are used:

"Densified carbon dioxide" means carbon dioxide that has a density (g/ml) greater than that of carbon dioxide gas at 1 atm and 20° C.

The term "densified carbon dioxide-philic" in reference to surfactants $R_nZ_{n'}$ wherein n and n' are each independently 1 to 50, means that the functional group, $R_nH$ is soluble in carbon dioxide at pressures of about 14.7 to about 10,000 psi and temperatures of about −78.5° C. to about 100° C. to greater than 10 weight percent. Preferably n and n' are each independently 1–35. Such functional groups ($R_nH$) include halocarbons, polysiloxanes and branched polyalkylene oxides.

The term "densified carbon dioxide-phobic" in reference to surfactants, $R_nZ_{n'}$, means that $Z_{n'}H$ will have a solubility in carbon dioxide at pressures of about 14.7 to about 10,000 psi and temperatures of about −78.5° C. to about 100° C. of less than 10 weight percent. The functional groups in $Z_{n'}H$ include carboxylic acids, phosphatyl esters, hydroxyls, $C_{1-30}$ alkylenes or alkenylenes, polyalkylene oxides, branched polyalkylene oxides, carboxylates, $C_{1-30}$ alkylene sulfonates, phosphates, glycerates, carbohydrates, nitrates, substituted or unsubstituted phenylenes and sulfates.

The hydrocarbon and halocarbon containing surfactants (i.e., $R_nZ_{n'}$, containing the $CO_2$-philic functional group, $R_nH$, and the $CO_2$-phobic group, $Z_{n'}H$) will have an HLB of less than 15, preferably less than 13 and most preferably less than 12.

The polymeric siloxane containing surfactants, $R_nZ_{n'}$, also designated $MD_xD^*_yM$ with M representing trimethylsiloxyl end groups, $D_x$ as a dimethylsiloxyl backbone ($CO_2$-philic functional group) and $D^*_y$ as one or more substituted methylsiloxyl groups substituted with $CO_2$-phobic $R^2$ or $R^3$ groups as described in the Detailed Description Section will have a $D_xD^*_y$ ratio of greater than 0.5:1, preferably greater than 0.7:1 and most preferably greater than 1:1.

The term "nonpolar stains" refers to those which are at least partially made by nonpolar organic compounds such as oily soils, sebum and the like.

The term "polar stains" is interchangeable with the term "hydrophilic stains" and refers to stains such as grape juice, coffee and tea.

The term "compound hydrophobic stains" refers to stains such as lipstick and red candle wax.

The term "particulate soils" means soils containing insoluble solid components such as silicates, carbon black, etc.

Densified carbon dioxide, preferably carbon dioxide in its liquid phase, is used in the inventive dry cleaning system. It is noted that other molecules having densified properties may also be employed alone or in mixture. These molecules include methane, ethane, propane, ammonia, butane, n-pentane, n-hexane, cyclohexane, n-heptane, ethylene, propylene, methanol, ethanol, isopropanol, benzene, toluene, p-xylene, sulfur dioxide, chlorotrifluoromethane, trichlorofluoromethane, perfluoropropane, chlorodifluoromethane, sulfur hexafluoride and nitrous oxide.

During the dry cleaning process, the temperature range is between about −78.5° C. and less than about 20° C., preferably about −56.2° C. to about 20° C. and most preferably about 0° C. to about 20° C. The pressure during cleaning is about 14.7 psi to about 10,000 psi, preferably about 75.1 psi to about 7,000 psi and most preferably about 300 psi to about 6,000 psi.

A "substituted methylsiloxyl group" is a methylsiloxyl group substituted with a $CO_2$-phobic group $R^2$ or $R^3$. $R^2$ or $R^3$ are each represented in the following formula:

$$-(CH_2)_a(C_6H_4)_b(A)_d-[(L)_e(A')_f]_n-(L')_gZ^2(G)_h$$

wherein a is 1–30, b is 0–1, $C_6H_4$ is substituted or unsubstituted with a $C_{1-10}$ alkylene or alkenylene and A, d, L, e, A', F, n L', g, $Z^2$, G and h are defined below, and mixtures of $R^2$ and $R^3$.

A "substituted phenylene" is an phenylene substituted with a $C_{1-30}$ alkylene, alkenylene or hydroxyl, preferably a $C_{1-20}$ alkylene or alkenylene.

A "substituted carbohydrate" is a carbohydrate substituted with a $C_{1-10}$ alkylene or alkenylene, preferably a $C_{1-5}$ alkylene.

The terms "polyalkylene oxide", "alkylene" and "alkenylene" each contain a carbon chain which may be either straight or branched unless otherwise stated.

Surfactant Adjunct

A surfactant which is effective for use in a densified carbon dioxide dry cleaning system requires the combination of densified carbon dioxide-philic functional groups with densified carbon dioxide-phobic functional groups (see definitions above). The resulting compound may form reversed micelles with the $CO_2$-philic functional groups extending into a continuous phase and the $CO_2$-phobic functional groups directed toward the center of the micelle.

The surfactant is present in an amount of from 0.001 to 10 wt. %, preferably 0.01 to 5 wt. %.

The $CO_2$-philic moieties of the surfactants are groups exhibiting low Hildebrand solubility parameters, as described in Grant, D. J. W. et al. "Solubility Behavior of Organic Compounds", Techniques of Chemistry Series, J. Wiley & Sons, N.Y. (1990) pp. 46–55 which describes the Hildebrand solubility equation, herein incorporated by reference. These $CO_2$-philic moieties also exhibit low polarizability and some electron donating capability allowing them to be solubilized easily in densified fluid carbon dioxide.

As defined above the $CO_2$-philic functional groups are soluble in densified carbon dioxide to greater than 10 weight percent, preferably greater than 15 weight percent, at pressures of about 14.7 to about 10,000 psi and temperatures of −78.5° C. to about 100° C.

Preferred densified $CO_2$-philic functional groups include halocarbons (such as fluoro-, chloro- and fluorochlorocarbons), polysiloxanes and branched polyalkylene oxides.

The $CO_2$-phobic portion of the surfactant molecule is obtained either by a hydrophilic or a hydrophobic functional group which is less than 10 weight percent soluble in densified $CO_2$, preferably less than 5 wt. %, at a pressures of about 14.7 to about 10,000 psi and temperatures of −78.5° C. to about 100° C. Examples of moieties contained in the $CO_2$-phobic groups include polyalkylene oxides, carboxylates, branched acrylate esters, $C_{1-30}$ hydrocarbons, phenylenes which are unsubstituted or substituted, sulfonates, glycerates, phosphates, sulfates and carbohydrates. Especially preferred $CO_2$-phobic groups include $C_{2-20}$ straight chain or branched alkylenes, polyalkylene oxides, glycerates, carboxylates, phosphates, sulfates and carbohydrates.

The $CO_2$-philic and $CO_2$-phobic groups may be directly connected or linked together via a linkage group. Such groups include ester, keto, ether, amide, amine, thio, alkylene, alkenylene, fluoroalkylene or fluoroalkenylene.

Surfactants which are useful in the invention may be selected from four groups of compounds. The first group of compounds has the following formula:

$$[(CX_3(CX_2)_a(CH_2)_b)_c(A)_d-[(L)_e-(A')_f]_n-(L')_g]_oZ^2(G)_h \quad (I)$$

wherein

X is F, Cl, Br, I and mixtures thereof, preferably F and Cl;

a is 1–30, preferably 1–25, most preferably 5–20;

b is 0–5, preferably 0–3;

c is 1–5, preferably 1–3;

A and A' are each independently a linking moiety representing an ester, a keto, an ether, a thio, an amido, an amino, a $C_{1-4}$ fluoroalkylene, a $C_{1-4}$ fluoroalkenylene, a branched or straight chain polyalkylene oxide, a phosphato, a sulfonyl, a sulfate, an ammonium and mixtures thereof;

d is 0 or 1;

L and L' are each independently a $C_{1-30}$ straight chained or branched alkylene or alkenylene or phenylene which is unsubstituted or substituted and mixtures thereof;

e is 0–3;

f is 0 or 1;

n is 0–10, preferably 0–5, most preferably 0–3;

g is 0–3;

o is 0–5, preferably 0–3;

$Z^2$ is a hydrogen, a carboxylic acid, a hydroxy, a phosphato, a phosphato ester, a sulfonyl, a sulfonate, a sulfate, a branched or straight-chained polyalkylene oxide, a nitryl, a glyceryl, an phenylene unsubstituted or substituted with a $C_{1-30}$ alkylene or alkenylene, (preferably $C_{1-25}$ alkylene), a carbohydrate unsubstituted or substituted with a $C_{1-10}$ alkylene or alkenylene (preferably a $C_{1-5}$ alkylene) or an ammonium;

G is an anion or cation such as $H^+$, $Na^+$, $Li^+$, $K^+$, $NH_4^+$ $Ca^{+2}$, $Mg^{+2}$; $Cl^-$, $Br^-$, $I^-$, mesylate, or tosylate; and h is 0–3, preferably 0–2.

Preferred compounds within the scope of the formula I include those having linking moieties A and A' which are each independently an ester, an ether, a thio, a polyalkylene oxide, an amido, an ammonium and mixtures thereof;

L and L' are each independently a $C_{1-25}$ straight chain or branched alkylene or unsubstituted phenylene; and $Z^2$ is a hydrogen, carboxylic acid, hydroxyl, a phosphato, a sulfonyl, a sulfate, an ammonium, a polyalkylene oxide, or a carbohydrate, preferably unsubstituted. G groups which are preferred include $H^+$, $Li^+$, $Na^+$, $NH^+_4$, $Cl^-$, $Br^-$ or tosylate.

Most preferred compounds within the scope of formula I include those compounds wherein A and A' are each independently an ester, ether, an amido, a polyalkylene oxide and mixtures thereof; L and L' are each independently a $C_{1-20}$ straight chain or branched alkylene or an unsubstituted phenylene; $Z^2$ is a hydrogen, a phosphato, a sulfonyl, a carboxylic acid, a sulfate, a polyalkylene oxide and mixtures thereof; and G is $H^+$, $Na^+$ or $NH_4^+$.

Non-limiting examples of compounds within the scope of formula I include the following:

Perhalogenated Surfactants $CF_3(CF_2)_aCH_2CH_2C(O)OX$
$CF_3(CF_2)_aCH_2C(O)OX$
$CF_3(CF_2)_aC(O)OX$ $CF_3(CF_2)_aCH_2CH_2C(O)O(CH_2)_mCH_3$
$CF_3(CF_2)_aCH_2C(O)O(CH_2)_mCH_3$
$CF_3(CF_2)_aC(O)O(CH_2)_mCH_3$ $CF_3(CF_2)_aCH_2CH_2OP(O)(OH)_2$
$CF_3(CF_2)_aCH_2OP(O)(OH)_2$
$CF_3(CF_2)_aOP(O)(OH)_2$ $[CF_3(CF_2)_aCH_2CH_2O]_2P(O)(OH)$
$[CF_3(CF_2)_aCH_2O]_2P(O)(OH)$
$[CF_3(CF_2)_aO]_2P(O)(OH)$ $CF_3(CF_2)_aCH_2CH_2SO_3G$
$CF_3(CF_2)_aCH_2SO_3G$
$CF_3(CF_2)_aSO_3G$ $CF_3(CF_2)_aCH_2CH_2C(O)(CH_2)_mCH_3$
$CF_3(CF_2)_aCH_2C(O)(CH_2)_mCH_3$
$CF_3(CF_2)_aC(O)(CH_2)_mCH_3$ $CF_3(CF_2)_aCH_2CH_2O(CH_2)_mCH_3$
$CF_3(CF_2)_aCH_2O(CH_2)_mCH_3$
$CF_3(CF_2)_aO(CH_2)_mCH_3$ $CF_3(CF_2)_aCH_2CH_2C(O)N[(CH_2)_mCH_3]_2$
$CF_3(CF_2)_aCH_2C(O)N[(CH_2)_mCH_3]_2$
$CF_3(CF_2)_aC(O)N[(CH_2)_mCH_3]_2$ $CF_3(CF_2)_aCH_2CH_2S(CH_2)_mC(O)OG$
$CF_3(CF_2)_aCH_2S(CH_2)_mC(O)OG$
$CF_3(CF_2)_aS(CH_2)_mC(O)OG$ $CF_3(CF_2)_aCH_2CH_2C(O)OCH_2CH_2[OCH_2CH(CH_3)]_pOH$
$CF_3(CF_2)_aCH_2C(O)OCH_2CH_2[OCH_2CH(CH_3)]_pOH$
$CF_3(CF_2)_aC(O)OCH_2CH_2[OCH_2CH(CH_3)]_pOH$ $CF_3(CF_2)_aCH_2CH_2C(O)OCH_2CH_2[OCH_2CH_2]_pOH$
$CF_3(CF_2)_aCH_2C(O)OCH_2CH_2[OCH_2CH_2]_pOH$
$CF_3(CF_2)_aC(O)OCH_2CH_2[OCH_2CH_2]_pOH$ $CF_3(CF_2)_aCH_2CH_2C(O)OCH_2CH_2OCH_2CH(OH)CH_2OH$
$CF_3(CF_2)_aCH_2C(O)OCH_2CH_2OCH_2CH(OH)CH_2OH$
$CF_3(CF_2)_aC(O)OCH_2CH_2OCH_2CH(OH)CH_2OH$ $CF_3(CF_2)_aCH_2CH_2O(CH_2)_aC(O)O(CH_2)_mCH_3$
$CF_3(CF_2)_aCH_2O(CH_2)_aC(O)O(CH_2)_mCH_3$
$CF_3(CF_2)_aO(CH_2)_aC(O)O(CH_2)_mCH_3$ $CF_3(CF_2)_aCH_2CH_2S(CH_2)_aC(O)O(CH_2)_mCH_3$
$CF_3(CF_2)_aCH_2S(CH_2)_aC(O)O(CH_2)_mCH_3$
$CF_3(CF_2)_aS(CH_2)_aC(O)O(CH_2)_mCH_3$ $CF_3(CF_2)_aCH_2CH_2O(CH_2)_a(OCH_2CH_2)_pOH$
$CF_3(CF_2)_aCH_2O(CH_2)_a(OCH_2CH_2)_pOH$
$CF_3(CF_2)_aO(CH_2)_a(OCH_2CH_2)_pOH$ $CF_3(CF_2)_aCH_2CH_2O(CH_2)_a(OCH_2CH(CH_3))_pOH$
$CF_3(CF_2)_aCH_2O(CH_2)_a(OCH_2CH(CH_3))_pOH$
$CF_3(CF_2)_aO(CH_2)_a(OCH_2CH(CH_3))_pOH$ $CF_3(CF_2)_aCH_2CH_2C(O)O(CH_2)_a(OCH_2CH_2)_pOH$
$CF_3(CF_2)_aCH_2C(O)O(CH_2)_a(OCH_2CH_2)_pOH$
$CF_3(CF_2)_aC(O)O(CH_2)_a(OCH_2CH_2)_pOH$ -continued Perhalogenated Surfactants $CF_3(CF_2)_aCH_2CH_2C(O)O(CH_2)_{a'}(OCH_2CH(CH_3))_pOH$
$CF_3(CF_2)_aCH_2C(O)O(CH_2)_{a'}(OCH_2CH(CH_3))_pOH$
$CF_3(CF_2)_aC(O)O(CH_2)_{a'}(OCH_2CH(CH_3))_pOH$ a = 1–30
a' = 1–20
m = 1–30
p = 1–50
G = $H^+$, $Na^+$, $K^+$, $NH_4^+$, $Mg^{+2}$, $Ca^{+2}$, etc.

$CF_3(CF_2)_aCH_2CH_2OCH_2CH_2OCH_2CH(OH)CH_2OH$
$CF_3(CF_2)_aCH_2OCH_2CH_2OCH_2CH(OH)CH_2OH$
$CF_3(CF_2)_aOCH_2CH_2OCH_2CH(OH)CH_2OH$ $[CF_3(CF_2)_aCH_2CH_2C(O)OCH_2]_2N(CH_2)_mCOOX$
$[CF_3(CF_2)_aCH_2C(O)OCH_2]_2N(CH_2)_mCOOX$
$[CF_3(CF_2)_aC(O)OCH_2]_2N(CH_2)_mCOOX$ $[CF_3(CF_2)_aCH_2CH_2C(O)OCH_2]_2CH(CH_2)_mCOOX$
$[CF_3(CF_2)_aCH_2C(O)OCH_2]_2CH(CH_2)_mCOOX$
$[CF_3(CF_2)_aC(O)OCH_2]_2CH(CH_2)_mCOOX$ $CF_3(CF_2)_aCH_2CH_2S(CH_2)_{a'}C(O)N[(CH_2)_mCH_3]_2$
$CF_2(CF_2)_aCH_2S(CH_2)_{a'}C(O)N[(CH_2)_mCH_3]_2$
$CF_3(CF_2)_aS(CH_2)_{a'}C(O)N[(CH_2)_mCH_3]_2$ $CF_3(CF_2)_aCH_2CH_2O(CH_2)_{a'}C(O)N[(CH_2)_mCH_3]_2$
$CF_3(CF_2)_aCH_2O(CH_2)_{a'}C(O)N[(CH_2)_mCH_3]_2$
$CF_3(CF_2)_aO(CH_2)_{a'}C(O)N[(CH_2)_mCH_3]_2$ $CH_2C(O)O(CF_2)_aCF_3$
|
$CH(SO_2G)C(O)O(CF_2)_aCF_3$ $CH(SO_3G)C(O)OCH_2CH_2(CF_2)_aCF_3$
|
$CH_2C(O)OCH_2CH_2(CF_2)_aCF_3$ $CH_2C(O)OCH_2(CF_2)_aCF_3$
|
$CH(SO_3G)C(O)OCH_2(CF_2)_aCF_3$

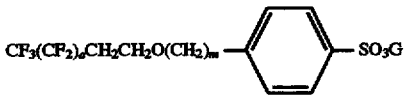

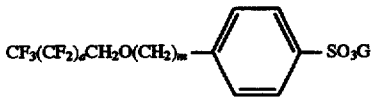

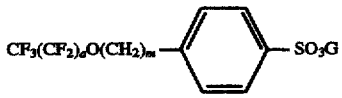

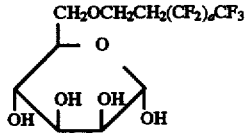

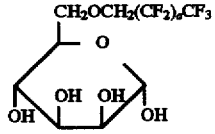

-continued

Perhalogenated Surfactants

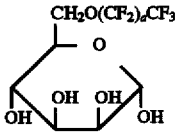

a = 1–30
a' = 1–20
m = 1–30
G = $H^+$, $N^+$, $K^+$, $Li^+$, $Ca^{+2}$, $Mg^{+2}$, $NH_4^+$, etc.

$CF_3(CF_2)_aCH_2CH_2C(O)(CH_2)_mN(CH_3)_3G$
$CF_3(CF_2)_aCH_2C(O)(CH_2)_mN(CH_3)_3G$
$CF_3(CF_2)_aC(O)(CH_2)_mN(CH_3)_3G$ $CClF_2(CClF)_aCH_2CH_2C(O)OX$
$CClF_2(CClF)_aCH_2C(O)OX$
$CClF_2(CClF)_aC(O)OX$ $CClF_2(CClF)_aCH_2CH_2C(O)O(CH_2)_mCH_3$
$CClF_2(CClF)_aCH_2C(O)O(CH_2)_mCH_3$
$CClF_2(CClF)_aC(O)O(CH_2)_mCH_3$ $CClF_2(CClF)_aCH_2CH_2OP(O)(OH)_2$
$CClF_2(CClF)_aCH_2OP(O)(OH)_2$
$CClF_2(CClF)_aOP(O)(OH)_2$ $[CClF_2(CClF)_aCH_2CH_2O]_2P(O)(OH)$
$[CClF_2(CClF)_aCH_2O]_2P(O)(OH)$
$[CClF_2(CClF)_aO]_2P(O)(OH)$ $CClF_2(CClF)_aCH_2CH_2SO_3G$
$CClF_2(ClCF)_2CH_2SO_3G$
$CClF_2(CClF)_aSO_3G$ $CClF_2(CClF)_aCH_2CH_2C(O)(CH_2)_mCH_3$
$CClF_2(CClF)_aCH_2C(O)(CH_2)_mCH_3$
$CClF_2(CClF)_aC(O)(CH_2)_mCH_3$ $CClF_2(CClF)_aCH_2CH_2S(CH_2)_{a'}C(O)O(CH_2)_mCH_3$
$CClF_2(CClF)_aCH_2S(CH_2)_{a'}C(O)O(CH_2)_mCH_3$
$CClF_2(CClF)_aS(CH_2)_{a'}C(O)O(CH_2)_mCH_3$ $CClF_2(CClF)_aCH_2CH_2O(CH_2)_{a'}(OCH_2CH_2)_pOH$
$CClF_2(CClF)_aCH_2O(CH_2)_{a'}(OCH_2CH_2)_pOH$
$CClF_2(CClF)_aO(CH_2)_{a'}(OCH_2CH_2)_pOH$ $CClF_2(CClF)_aCH_2CH_2O(CH_2)_{a'}(OCH_2CH(CH_3))_pOH$
$CClF_2(CClF)_aCH_2O(CH_2)_{a'}(OCH_2CH(CH_3))_pOH$
$CClF_2(CClF)_aO(CH_2)_{a'}(OCH_2CH(CH_3))_pOH$ $CClF_2(CClF)_aCH_2CH_2C(O)(CH_2)_mN(CH_3)_3G$
$CClF_2(CClF)_aCH_2C(O)(CH_2)_mN(CH_3)_3G$
$CClF_2(CClF)_aC(O)(CH_2)_mN(CH_3)_3G$ $CClF_2(CClF)_aCH_2CH_2O(CH_2)_mCH_3$
$CClF_2(CClF)_aCH_2O(CH_2)_mCH_3$
$CClF_2(CClF)_aO(CH_2)_mCH_3$ $CClF_2(CClF)_aCH_2CH_2C(O)N[(CH_2)_mCH_3]_2$
$CClF_2(CClF)_aCH_2C(O)N[(CH_2)_mCH_3]_2$
$CClF_2(CClF)_aC(O)N[(CH_2)_mCH_3]_2$ a = 1–30
a' = 1–20
m = 1–30
p = 1–50
G = $H^+$, $Na^+$, $K^+$, $NH_4^+$, $Mg^{+2}$, $Ca^{+2}$, $Cl^-$, $Br^-$, $^-OTs$, $^-OMs$, etc.

Compounds of formula I are prepared by any conventional preparation method known in the art such as the one described in March, J., "Advanced Organic Chemistry", J. Wiley & Sons, N.Y. (1985).

Commercially available fluorinated compounds include compounds supplied as the Zonyl™ series by Dupont.

The second group of surfactants useful in the dry cleaning system are those compounds having a polyalkylene moiety and having a formula (II).

$$[H\text{-}(CH(R^4)-CH(R^5)-O)_i-(A)_d-[(L)_e-(A')_f]_n-(L')_g]_oZ^2(G)_h \quad \text{(II)}$$

wherein $R^4$ and $R^5$ each represent a hydrogen, a $C_{1-5}$ straight chained or branched alkylene or alkylene oxide and mixtures thereof;

i is 1 to 50, preferably 1 to 30, and

A, A', d, L, L', e f, n, g, o, $Z^2$, G and h are as defined above.

Preferably $R^4$ and $R^5$ are each independently a hydrogen, a $C_{1-3}$ alkylene, or alkylene oxide and mixtures thereof.

Most preferably $R^4$ and $R^5$ are each independently a hydrogen, $C_{1-3}$ alkylene and mixtures thereof. Non-limiting examples of compounds within the scope of formula II are:

Polypropylene Glycol Surfactants $HO(CH_2CH(CH_3)O)_i(CH_2CH_2O)_jH$
$HO(CH(CH_3)CH_2O)_i(CH_2CH_2O)_jH$
$HO(CH_2CH(CH_3)O)_i(CH_2CH_2O)_j(CH_2CH(CH_3)O)_kH$
$HO(CH(CH_3)CH_2O)_i(CH_2CH_2O)_j(CH_2CH(CH_3)O)_kH$
$HO(CH_2CH(CH_3)O)_i(CH_2CH_2O)_j(CH(CH_3)CH_2O)_kH$
$HO(CH(CH_3)CH_2O)_i(CH_2CH_2O)_j(CH(CH_3)CH_2O)_kH$ $HO(CH_2CH_2O)_i(CH_2CH(CH_3)O)_j(CH_2CH_2O)_kH$
$HO(CH_2CH_2O)_i(CH(CH_3)CH_2O)_j(CH_2CH_2O)_kH$ $HO(CH(CH_3)CH_2O)_iC(O)(CH_2)_mCH_3$
$HO(CH_2CH(CH_3)O)_iC(O)(CH_2)_mCH_3$
$HO(CH(CH_3)CH_2O)_i(CH_2)_mCH_3$
$HO(CH_2CH(CH_3)O)_i(CH_2)_mCH_3$
$HO(CH(CH_3)CH_2O)_iC(O)O(CH_2)_mCH_3$
$HO(CH_2CH(CH_3)O)_iC(O)O(CH_2)_mCH_3$
$HO(CH(CH_3)CH_2O)_iC(O)N[(CH_2)_mCH_3]_2$
$HO(CH_3CH(CH_3)O)_iC(O)N[(CH_2)_mCH_3]_2$ $HO(CH(CH_3)CH_2O)_iC(O)(CH_2)_mCOOG$
$HO(CH_2CH(CH_3)O)_iC(O)(CH_2)_mCOOG$
$HO(CH(CH_3)CH_2O)_i(CH_2)_mCOOG$
$HO(CH_2CH(CH_3)O)_i(CH_2)_mCOOG$
$HO(CH(CH_3)CH_2O)_iC(O)O(CH_2)_mCOOG$
$HO(CH_2CH(CH_3)O)_iC(O)O(CH_2)_mCOOG$
$HO(CH(CH(CH_3)CH_2O)_iC(O)N[(CH_2)_mCOOG]_2$
$HO(CH_2CH(CH_3)O)_iC(O)N[(CH_2)_mCOOG]_2$ $HO(CH(CH_3)CH_2O)_iC(O)(CH_2)_mSO_3G$
$HO(CH_2CH(CH_3)O)_iC(O)(CH_2)_mSO_3G$
$HO(CH(CH_3)CH_2O)_i(CH_2)_mSO_3G$
$HO(CH_2CH(CH_3)O)_i(CH_2)_mSO_3G$ $HO(CH(CH_3)CH_2O)_iC(O)CH_2CH_2OCH_2CH(OH)CH_2OH$
$HO(CH_2CH(CH_3)O)_iC(O)CH_2CH_2OCH_2CH(OH)CH_2OH$
$HO(CH(CH_3)CH_2O)_iCH_2CH_2OCH_2CH(OH)CH_2OH$
$HO(CH_2CH(CH_3)O)_iCH_2CH_2OCH_2CH(OH)CH_2OH$ $HO(CH(CH_3)CH_2O)_iC(O)(CH_2)_mN(CH_3)_3G$
$HO(CH_2CH(CH_3)O)_iC(O)(CH_2)_mN(CH_3)_3G$
$HO(CH(CH_3)CH_2O)_i(CH_2)_mN(CH_3)_3G$
$HO(CH_2CH(CH_3)O)_i(CH_2)_mN(CH_3)_3G$
$HO(CH(CH_3)CH_2O)_iC(O)O(CH_2)_mN(CH_3)_3G$
$HO(CH_2CH(CH_3)O)_iC(O)O(CH_2)_mN(CH_3)_3G$

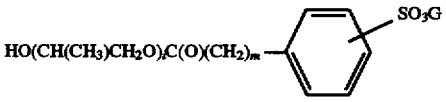

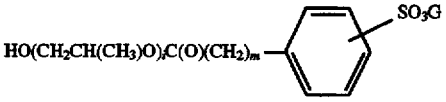

-continued

Polypropylene Glycol Surfactants

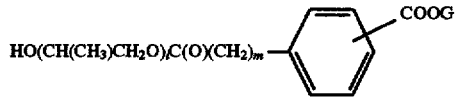

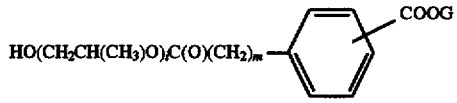

$CH_2C(O)O(CH(CH_3)CH_2O)_iH$
$CH_2(SO_3G)C(O)O(CH_2CH(CH_3)O)_iH$ $CH_2C(O)O(CH_2CH(CH_3)O)_iH$
$CH_2(SO_3G)C(O)O(CH(CH_3)CH_2O)_iH$ $CH_2C(O)N[(CH(CH_3)CH_2O)_iH]_2$
$CH_2(SO_3G)C(O)N[(CH_2CH(CH_3)O)_iH]_2$ $CH_2C(O)N[(CH_2CH(CH_3)O)_iH]_2$
$CH_2(SO_3G)C(O)N[(CH(CH_3)CH_2O)_iH]_2$

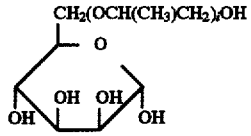

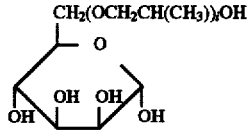

i = 1–50, j = 1–50, k = 1–50,
m = 1–30
G = $H^+$, $Na^+$, $K^+$, $NH_4^+$, $Ca^{+2}$, $Mg^{+2}$, $Cl^-$, $Br^-$, $^-OTs$, $^-OMs$, etc.

Compounds of formula II may be prepared as is known in the art and as described in March et al., Supra.

Examples of commercially available compounds of formula II may be obtained as the Pluronic series from BASF, Inc.

A third group of surfactants useful in the invention contain a halogenated oxide moiety and the compounds have a formula:

$$[(CX_3(XO)_r(T)_s)_c(A)_d-[(L)_e-(A')_f-]_n(L')_g]_oZ^2(G)_h \quad \text{(III)}$$

wherein

XO is a halogenated alkylene oxide having $C_{1-6}$ straight or branched halocarbons, preferably $C_{1-3}$, r is 1–50, preferably 1–25, most preferably 5–20, T is a straight chained or branched haloalkylene or halophenylene, s is 0 to 5, preferably 0–3, X, A, A', c, d, L, L', e, f, n, g, o, $Z^2$, G and h are as defined above.

Non-limiting examples of halogenated oxide containing compounds include:

Perhaloether Surfactants $CF_3(CF_2CF_2O)_r(CH_2CH_2O)_tH$
$CF_3(CF_2CF_2O)_r(CH_2CH(CH_3)O)_tH$
$CF_3(CF_2CF(CF_3)O)_r(CH_2CH_2O)_tH$
$CF_3(CF_2CF(CF_3)O)_r(CH_2CH(CH_3)O)_tH$ $CF_3(CF_2CF_2O)_rP(O)(OH)_2$
$CF_3(CF_2CF_2O)_rCF_2P(O)(OH)_2$
$CF_3(CF_2CF_2O)_rCF(CF_3)P(O)(OH)_2$
$[CF_3(CF_2CF_2O)_r]_2P(O)(OH)$
$[CF_3(CF_2CF_2O)_rCF_2]_2P(O)(OH)$
$[CF_3(CF_2CF_2O)_rCF(CF_2)]_2P(O)(OH)$
$CF_3(CF_2CF(CF_3)O)_rP(O)(OH)_2$
$CF_3(CF_2CF(CF_3)O)_rCF_2P(O)(OH)_2$
$CF_3(CF_2CF(CF_3)O)_rCF(CF_3)P(O)(OH)_2$
$[CF_3(CF_2CF(CF_3)O)_r]_2P(O)(OH)$
$[CF_3(CF_2CF(CF_3)O)_rCF_2)]_2P(O)(OH)$
$[CF_3(CF_2CF(CF_3)O)_rCF(CF_3)]_2P(O)(OH)$ $CF_3(CF_2CF_2O)_rC(O)OG$
$CF_3(CF_2CF_2O)_rCF_2C(O)OG$
$CF_3(CF_2CF_2O)_rCF(CF_3)C(O)OG$
$CF_3(CF_2CF(CF_3)O)_rC(O)OG$
$CF_3(CF_2CF(CF_3)O)_rCF_2C(O)OG$
$CF_3(CF_2CF(CF_3)O)_rCF(CF_3)C(O)OG$ $CF_3(CF_2CF_2O)_rC(O)O(CH_2)_mCH_3$
$CF_3(CF_2CF_2O)_rCF_2C(O)O(CH_2)_mCH_3$
$CF_3(CF_2CF_2O)_rCF(CF_3)C(O)O(CH_2)_mCH_3$
$CF_3(CF_2CF(CF_3)O)_rC(O)O(CH_2)_mCH_3$
$CF_3(CF_2CF(CF_3)O)_rCF_2C(O)O(CH_2)_mCH_3$
$CF_3(CF_2CF(CF_3)O)_rCF(CF_3)C(O)O(CH_2)_mCH_3$ $CF_3(CF_2CF_2O)_nC(O)OCH_2CH_2OCH_2CH(OH)CH_2OH$
$CF_3(CF_2CF_2O)_nCF_2C(O)OCH_2CH_2OCH_2CH(OH)CH_2OH$
$CF_3(CF_2CF(CF_3)O)_nC(O)OCH_2CH_2OCH_2CH(OH)CH_2OH$ $CF_3(CF_2CF_2O)_rC(O)N[(CH_2)_mCH_3]_2$
$CF_3(CF_2CF_2O)_rCF_2C(O)N[(CH_2)_mCH_3]_2$
$CF_3(CF_2CF_2O)_rCF(CF_3)C(O)N[(CH_2)_mCH_3]_2$
$CF_3(CF_2CF(CF_3)O)_rC(O)N[(CH_2)_mCH_3]_2$
$CF_3(CF_2CF(CF_3)O)_rCF_2C(O)N[(CH_2)_mCH_3\}_2$
$CF_3(CF_2CF(CF_3)O)_rCF(CF_3)C(O)N[(CH_2)_mCH_3]_2$ $CF_3(CF_2CF_2O)_rO(CH_2)_mCH_3$
$CF_3(CF_2CF_2)O)_rCF_2O(CH_2)_mCH_3$
$CF_3(CF_2CF_2O)_rCF(CF_3)O(CH_2)_mCH_3$
$CF_3(CF_2CF(CF_3)O)_rO(CH_2)_mCH_3$
$CF_3(CF_2CF(CF_3)O)_rCF_2O(CH_2)_mCH_3$
$CF_3(CF_2CF(CF_3)O)_rCF(CF_3)O(CH_2)_mCH_3$ $CF_3(CF_2CF_2O)_rC(O)O(CH_2)_mSO_3G$
$CF_3(CF_2CF_2O)_rCF_2C(O)O(CH_2)_mSO_3G$
$CF_3(CF_2CF_2O)_rCF(CF_3)C(O)O(CH_2)_mSO_3G$
$CF_3(CF_2CF(CF_3)O)_rC(O)O(CH_2)_mSO_3G$
$CF_3(CF_2CF(CF_3)O)_rCF_2C(O)O(CH_2)_mSO_3G$
$CF_3(CF_2CF(CF_3)O)_rCF(CF_3)C(O)O(CH_2)_mSO_3G$ $CF_3(CF_2CF_2O)_rC(O)O(CH_2)_mCO_2G$
$CF_3(CF_2CF_2O)_rCF_2C(O)O(CH_2)_mCO_2G$
$CF_3(CF_2CF(CF_3)O)_rC(O)O(CH_2)_mCO_2G$
$CF_3(CF_2CF(CF_3)O)_rCF_2C(O)O(CH_2)_mCO_2G$
$CF_3(CF_2CF(CF_3)O)_rCF(CF_3)C(O)O(CH_2)_mCO_2G$ $CF_3(CF_2CF_2O)_rC(O)(CH_2)_mCH_3$
$CF_3(CF_2CF_2O)_rCF_2C(O)(CH_2)_mCH_3$
$CF_3(CF_2CF_2O)_rCF(CF_3)C(O)(CH_2)_mCH_3$
$CF_3(CF_2CF(CF_3)O)_rC(O)(CH_2)_mCH_3$
$CF_3(CF_2CF(CF_3)O)_rCF_2C(O)(CH_2)_mCH_3$
$CF_3(CF_2CF(CF_3)O)_rCF(CF_3)C(O)(CH_2)_mCH_3$ $CF_3(CF_2CF_2O)_rC(O)(CH_2)_mN(CH_3)_3G$
$CF_3(CF_2CF_2O)_rCF_2C(O)(CH_2)_mN(CH_3)_3G$
$CF_3(CF_2CF_2O)_rCF(CF_3)C(O)(CH_2)_mN(CH_3)_3G$
$CF_3(CF_2CF(CF_3)O)_rC(O)(CH_2)_mN(CH_3)_3G$
$CF_3(CF_2CF(CF_3)O)_rCF_2C(O)(CH_2)_mN(CH_3)_3G$
$CF_3(CF_2CF(CF_3)O)_rCF(CF_3)C(O)(CH_2)_mN(CH_3)_3G$ r = 1–30
t = 1–40

-continued

Perhaloether Surfactants m = 1–30
G = $H^+$, $Na^+$, $K^+$, $Li^+$, $NH_4^+$, $Ca^{+2}$, $Mg^{+2}$, $Cl^-$, $Br^-$, $^-OTs$, $^-OMs$, etc.

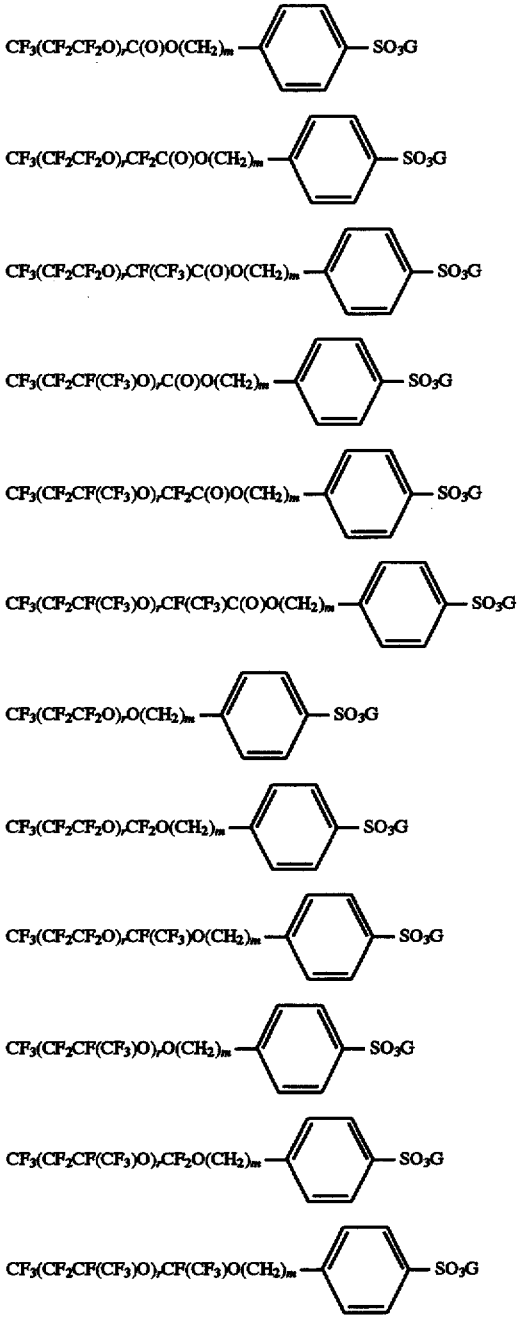

$CH_2OC(O)CF_2CF_2O)_rCF_3$
|
$CH(SO_3G)OC(O)(CF_2CF_2O)_rCF_3$ $CH_2OC(O)CF_2(CF_2CF_2O)_rCF_3$
|
$CH(SO_3G)OC(O)CF_2(CF_2CF_2O)_rCF_3$ $CH_2OC(O)CF(CF_3)(CF_2CF_2O)_rCF_3$
|
$CH(SO_3G)OC(O)CF(CF_3)(CF_2CF_2O)_rCF_3$

-continued

Perhaloether Surfactants $CH_2OC(O)CF_2CF(CF_3)O)_rCF_3$
|
$CH(SO_3G)OC(O)(CF_2CF(CF_3)O)_rCF_3$ $CH_2OC(O)CF_2(CF_2CF(CF_3)O)_rCF_3$
|
$CH(SO_3G)OC(O)CF_2(CF_2CF(CF_3)O)_rCF_3$ $CH_2OC(O)CF(CF_3)(CF_2CF(CF_3)O)_rCF_3$
|
$CH(SO_3G)OC(O)CF(CF_3)(CF_2CF(CF_3)O)_rCF_3$ r = 1–30
m = 1–30
G = $H^+$, $Na^+$, $Li^+$, $K^+$, $NH_4^+$, $Ca^{+2}$, $Mg^{+2}$, $Cl^-$, $Br^-$, $^-OTs$, $^-OMs$, etc.

$CClF_2(CClFCClFO)_x(CH_2CH_2O)_yH$
$CClF_2(CClFCClFO)_x(CH_2CH(CH_3)O)_yH$
$CClF_2(CClFCF(CClF_2)O)_x(CH_2CH_2O)_yH$
$CClF_2(CClFCF(CClF_2)O)_x(CH_2CH(CH_3)O)_yH$ $CClF_2(CClFCClFO)_xP(O)(OH)_2$
$CClF_2(CClFCClFO)_xCF_2P(O)(OH)_2$
$CClF_2(CClFCClFO)_xCF(CF_3)P(O)(OH)_2$
$[CClF_2(CClFCClFO)_x]_2P(O)(OH)$
$[CClF_2(CClFCClFO)_xCF_2]_2P(O)(OH)$
$[CClF_2(CClFCClFO)_xCF(CF_3)]_2P(O)(OH)$
$CClF_2(CClFCF(CClF_2)O)_xP(O)(OH)_2$
$CClF_2(CClFCF(CClF_2)O)_xCF_2P(O)(OH)_2$
$CClF_2(CClFCF(CClF_2)O)_xCF(CF_3)P(O)(OH)_2$
$[CClF_2(CClFCF(CClF_2)O)_x]_2P(O)(OH)$
$[CClF_2(CClFCF(CClF_2)O)_xCF_2]_2P(O)(OH)$
$[CClF_2(CClFCF(CClF_2)O)_xCF(CF_3)]_2P(O)(OH)$ $CClF_2(CClFCClFO)_xC(O)OG$
$CClF_2(CClFCClFO)_xCF_2C(O)OG$
$CClF_2(CClFCClFO)_xCF(CF_3)C(O)OG$
$CClF_2(CClFCF(CClF_2)O)_xC(O)OG$
$CClF_2(CClFCF(CClF_2)O)_xCF_2C(O)OG$
$CClF_2(CClFCF(CClF_2)O)_xCF(CF_3)C(O)OG$ r = 1–30
t = 1–40
G = $H^+$, $Na^+$, $Li^+$, $K^+$, $NH_4^+$, $Mg^{+2}$, $Ca^{+2}$, $Cl^-$, $Br^-$, $^-OTs$, $^-OMs$, etc.

Examples of commercially available compounds within the scope of formula III include those compounds supplied under the Krytox™ series by DuPont having a formula:

$$CF_3(\underset{\underset{CF_3}{|}}{CF}CF_2O)_xCF(CF_3)\overset{\overset{O}{||}}{C}O^-NH_4^+$$

wherein x is 1–50.

Other compounds within the scope of formula III are made as known in the art and described in March et al., Supra.

The fourth group of surfactants useful in the invention include siloxanes containing surfactants of formula IV $$MD_xD^*_yM \qquad (IV)$$

wherein M is a trimethylsiloxyl end group, $D_x$ is a dimethylsiloxyl backbone which is $CO_2$-philic and $D^*_y$ is one or more methylsiloxyl groups which are substituted with a $CO_2$-phobic $R^2$ or $R^3$ group, wherein $R^2$ and $R^3$ each independently have the following formula:

$$(CH_2)_a(C_6H_4)_b(A)_d-[(L)_e-(A')_f-]_n-(L')_gZ^2(G)_h$$

wherein a is 1–30, preferably 1–25, most preferably 1–20, b is 0 or 1, $C_6H_4$ is unsubstituted or substituted with a $C_{1-10}$ alkylene or alkenylene, and A, A', d, L, e, f, n, L', g, $Z^2$, G and h are as defined above and mixtures of $R^2$ and $R^3$ thereof.

The $D_x$:$D^*_y$ ratio of the siloxane containing surfactants should be greater than 0.5:1 preferably greater than 0.7:1 and most preferably greater than 1:1.

The siloxane compounds should have a molecular weight ranging from 100 to 100,000, preferably 200 to 50,000, most preferably 500 to 35,000.

Silicones may be prepared by any conventional method such as the method described in Hardman, B. "Silicones" the *Encyclopedia of Polymer Science and Engineering,* v. 15, 2nd Ed., J. Wiley and Sons, NY, N.Y. (1989).

Examples of commercially available siloxane containing compounds which may be used in the invention are those supplied under the ABIL series by Goldschmidt.

Suitable siloxane compounds within the scope of formula IV are compounds of formula V:

$$(CH_3)_3-Si-O-\left[\begin{array}{c}CH_3\\|\\Si-O\\|\\CH_3\end{array}\right]_x-\left[\begin{array}{c}CH_3\\|\\Si-O\\|\\R^2\end{array}\right]_y-\left[\begin{array}{c}CH_3\\|\\Si-O\\|\\R^3\end{array}\right]_{y'}-Si-(CH_3)_3 \qquad (V)$$

the ratio of x:y and y' is greater than 0.5:1, preferably greater than 0.7:1 and most preferably greater than 1:1, and $R^2$ and $R^3$ are as defined above.

Preferred $CO_2$-phobic groups represented by $R^2$ and $R^3$ include those moieties of the following formula:

$$(CH_2)_a(C_6H_4)_b(A)_d-[(L)_e-(A')_f-]-(L')_gZ^2(G)_h$$

wherein a is 1–20, b is 0, $C_6H_4$ is unsubstituted,

A, A', d, L, e, f, n, g, $Z^2$, G and h are as defined above, and mixtures of $R^2$ and $R^3$.

Non-limiting examples of polydimethylsiloxane surfactants substituted with $CO_2$-phobic $R^2$ or $R^3$ groups are:

Polydimethylsiloxane Surfactants

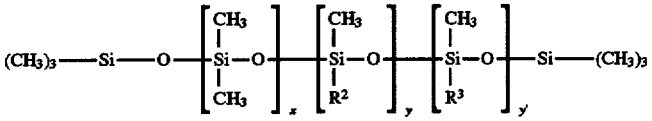

x = 1–300; y = 1–100; y' = 1–100

$R^2$ or $R^3$ = $(CH_2)_aCH_3$

= $(CH_2)_aCH{=}CH(CH_2)_mCH_3$

= $(CH_2)_aO(CH_2)_mCH_3$
= $(CH_2)_aS(CH_2)_mCH_3$
= $(CH_2)_aN[(CH_2)_mCH_3]_2$

= $(CH_2)_aC(O)O(CH_2)_mCH_3$
= $(CH_2)_aC(O)(CH_2)_mCH_3$
= $(CH_2)_aC(O)N[(CH_2)_mCH_3]_2$ $R^2$ or $R^3$ = $(CH_2)_a$ 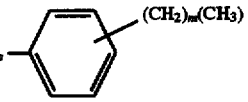

= $(CH_2)_a$ 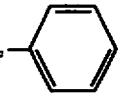

= $(CH_2)_aCH{=}CH(CH_2)_m$ 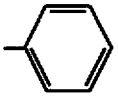

a = 1–30
m = 1–30

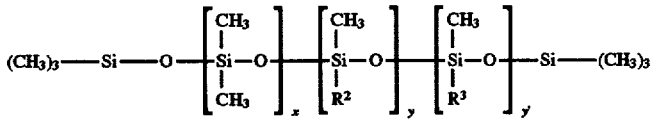

x = 1–300; y = 1–100; y' = 1–100

$R^2$ or $R^3$ = $(CH_2)_a(CH_2CH_2O)_pH$

= $(CH_2)_a(CH_2CH_2O)_pCH_3$
= $(CH_2)_a(CH_2CH_2O)_p(CH_2)_mCH_3$
= $(CH_2)_a(CH_2CH(CH_3)O)_pH$
= $(CH_2)_a(CH_2CH(CH_3)O)_pCH_3$
= $(CH_2)_a(CH_2CH(CH_3)O)_p(CH_2)_mCH_3$

= $(CH_2)_aCOOG$
= $(CH_2)_aSO_2G$
= $(CH_2)_aOP(O)(OG)_2$
= $[(CH_2)_aO]P(O)(O(CH_2)_mCH_3)(OG)$

= $(CH_2)_aO(CH_2)_mCOOG$
= $(CH_2)_aS(CH_2)_mCOOG$
= $(CH_2)_aN[(CH_2)_mCOOG]_2$
= $(CH_2)_aO(CH_2)_mSO_3G$
= $(CH_2)_aS(CH_2)_mSO_3G$
= $(CH_2)_aN[(CH_2)_mSO_3G]_2$
= $(CH_2)_aO(CH_2)_mOP(O)(OG)_2$
= $(CH_2)_aS(CH_2)_mOP(O)(OG)_2$

= $(CH_2)_aO(CH_2)_mN(CH_3)_3G$
= $(CH_2)_aO(CH_2)_mN(CH_3)_3G$ $R^2$ or $R^3$ = $(CH_2)_aOCH_2CH(OH)CH_2OH$

= $(CH_2)_a(OCH_2CH_2)_p(OCH_2CH(CH_3))_p.OH$
= $(CH_2)_a(OCH_2CH_2)_p(OCH(CH_3)CH_2)_p.OH$
= $(CH_2)_a(OCH_2CH_2)_p(CH_2)_mCOOG$
= $(CH_2)_a(OCH_2CH_2)_p(CH_2)_mSO_3G$

-continued

Polydimethylsiloxane Surfactants $R^2$ $= (CH_2)_a$ — COOG $= (CH_2)_a$ — $SO_3G$ $= (CH_2)_aO(CH_2)_m$ — COOG $= (CH_2)_aS(CH_2)_m$ — COOG $= (CH_2)_aO(CH_2)_m$ — $SO_3G$ $= (CH_2)_aS(CH_2)_m$ — $SO_3G$ $= HO$ — $CH_2O(CH_2)_aCH_3$, O, OH, OH, OH a = 1–30
m = 0–40
p = 0–50, p' = 0–50
G = $H^+$, $Na^+$, $K^+$, $NH_4^+$, $Mg^{+2}$, $Ca^{+2}$, $Cl^-$, $Br^-$, $^-OTs$, $^-OMs$, etc.

Enzymes

Enzymes may additionally be added to the dry cleaning system of the invention to improve stain removal. Such enzymes include proteases (e.g., Alcalase®, Savinase® and Esperase® from Novo Industries A/S); amylases (e.g., Termamyl® and Duramyl® bleach resistant amylases from Novo Industries A/S); lipases (e.g., Lipolase® from Novo Industries A/S); and oxidases. The enzyme should be added to the cleaning drum in an amount from 0.001% to 10%, preferably 0.01% to 5%. The type of soil dictates the choice of enzyme used in the system. The enzymes should be delivered in a conventional manner, such as by preparing an enzyme solution, typically of 1% by volume (i.e., 3 mls enzyme in buffered water or solvent).

Modifiers

In a preferred embodiment, a modifier such as water, or a useful organic solvent may be added to the cleaning drum in a small volume. Water may be added separately or may come into the drum in the form of water absorbed onto the fabrics to be drycleaned. Preferred amounts of modifier should be 0.0% to about 10% by volume, more preferably 0.001% to about 5% by volume, most preferably about 0.001% to about 3%. Preferred solvents include water, acetone, glycols, acetonitrile, $C_{1-10}$ alcohols and $C_{5-15}$ hydrocarbons. Especially preferred solvents include water, ethanol and methanol and hexane.

Peracid Precursors

Organic peracids which are stable in storage and which solubilize in densified carbon dioxide are effective at bleaching stains in the dry cleaning system. The selected organic peracid should be soluble in carbon dioxide to greater than 0.001 wt. % at pressures of about 14.7 to about 10,000 psi and temperatures of about −78.5° C. to about 100° C. The peracid compound should be present in an amount of about 0.01% to about 5%, preferably 0.1% to about 3%.

The organic peroxyacids usable in the present invention can contain either one or two peroxy groups and can be either aliphatic or aromatic. When the organic peroxyacid is aliphatic, the unsubstituted acid has the general formula:

$$HO-O-\overset{\overset{\displaystyle O}{\|}}{C}-(CH_2)_n-Y$$

where Y can be, for example, H, $CH_3$, $CH_2Cl$, COOH, or COOOH; and n is an integer from 1 to 20.

When the organic peroxy acid is aromatic, the unsubstituted acid has the general formula:

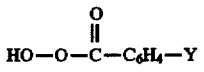

wherein Y is hydrogen, alkylene, alkylenehalogen, halogen, or COOH or COOOH.

Typical monoperoxyacids useful herein include alkylene peroxyacids and phenylene peroxyacids such as:

(i) peroxybenzoic acid and ring-substituted peroxybenzoic acid, e.g. peroxy-α-naphthoic acid;

(ii) aliphatic, substituted aliphatic and phenylenealkylene monoperoxy acids, e.g. peroxylauric acid, peroxystearic acid, and N,N-phthaloylaminoperoxycaproic acid (PAP); and (iii) amidoperoxy acids, e.g. mononononylamide of either peroxysuccinic acid (NAPSA) or of peroxyadipic acid (NAPAA).

Typical diperoxy acids useful herein include alkylene diperoxy acids and phenylenediperoxy acids, such as:

(iii) 1,12-diperoxydodecanedioic acid;

(iv) 1,9-diperoxyazelaic acid;

(v) diperoxybrassylic acid; diperoxysebacic acid and diperoxyisophthalic acid;

(vi) 2-decyldiperoxybutane-1,4-dioic acid;

(vii) 4,4'-sulfonylbisperoxybenzoic acid; and (viii) N,N'-terephthaloyl-di(6-aminoperoxycaproic acid) (TPCAP).

Particularly preferred peroxy acids include PAP, TPCAP, haloperbenzoic acid and peracetic acid.

Dry Cleaning Process

A process of dry cleaning using densified carbon dioxide as the cleaning fluid is schematically represented in FIG. 1. A cleaning vessel 5, preferably a rotatable drum, receives soiled fabrics as well as the selected surfactant, modifier, enzyme, peracid and mixtures thereof. The cleaning vessel may also be referred to as an autoclave, particularly as described in the examples below.

Densified carbon dioxide is introduced into the cleaning vessel from a storage vessel 1. Since much of the $CO_2$ cleaning fluid is recycled within the system, any losses during the dry cleaning process are made up through a $CO_2$ supply vessel 2. The $CO_2$ fluid is pumped into the cleaning vessel by a pump 3 at pressures ranging between about 14.7 and about 10,000 psi, preferably about 75.1 to about 7000 psi, most preferably about 300 psi to about 6000 psi. The $CO_2$ fluid is maintained at temperatures of about −78.5° C. to about 20° C., preferably about −56.2° C. to about 20° C., most preferably about 0° C. to about 20° C. by a heat exchanger 4 or by pumping a cooling solution through an internal condenser.

As an example of the operation of the system, the densified $CO_2$ is transferred from the supply vessel 2 to the cleaning vessel 5 through line 7 for a dry cleaning cycle of between about 15 to about 30 minutes. Before or during the cleaning cycle, surfactants, modifiers, enzymes, peracid and mixtures thereof as discussed above are introduced into the cleaning vessel, preferably through a line and pump system connected to the cleaning vessel.

At the end of the dry cleaning cycle, dirty $CO_2$, soil and spent cleaning agents are transferred through an expansion valve 6, a heat exchanger 8 by way of a line 9 into a flash drum 10. In the flash drum, pressures are reduced to between about 260 and about 1,080 psi (i.e. just below the critical pressure of $CO_2$) and to a temperature of about −23° C. to about 31° C. (i.e. just below the critical temperature of $CO_2$). Gaseous $CO_2$ is separated from the soil and spent agents and transferred via line 11 through a filter 12 and condenser 13 to be recycled back to the supply vessel 2. Any pressure losses are recovered by using pump 16. The spent agents and residue $CO_2$ are transferred via line 14 to an atmospheric tank 15, where the remaining $CO_2$ is vented to the atmosphere.

Other processes known in the art may be used in the claimed dry cleaning system such as those described in Dewees et al., U.S. Pat. No. 5,267,455, owned by The Clorox Company and JP 08052297 owned by Hughes Aircraft Co., herein incorporated by reference.

The following examples will more fully illustrate the embodiments of the invention. All parts, percentages and proportions referred to herein and in appended claims are by weight unless otherwise indicated. The definition and examples are intended to illustrate and not limit the scope of the invention.

EXAMPLE 1

Hydrocarbon and fluorocarbon containing surfactants useful in the invention must exhibit a hydrophilic/lipophilic balance of less than 15. This example describes the calculation of HLB values for various surfactants to determine their effectiveness in supercritical carbon dioxide. This calculation for various hydrocarbon and fluorocarbon surfactants is reported in the literature[1] and is represented by the following equation:

$$HLB=7+\Sigma(\textit{hydrophilic group numbers})-\Sigma(\textit{lipophilic group numbers})$$

The hydrophilic and lipophilic group numbers have been assigned to a number of common surfactant functionalities including hydrophilic groups such as carboxylates, sulfates and ethoxylates and lipophilic groups such as —$CH_2$, $CF_2$ and PPG's.[1] These group numbers for the functional groups in surfactants were utilized to calculate the HLB number for the following hydrocarbon or fluorocarbon surfactant:

| | Surfactant | Trade Name | HLB |
|---|---|---|---|
| 1 | $CF_3(CF_2)_8CH_2H_2O(CH_2CH_2O)_8H$ | Zonyl FSN[2] | 2.1 |
| 2 | $CF_3(CF_2)_8CH_2CH_2O(CH_2CH_2O)_{12}H$ | Zonyl FSO[3] | 3.4 |
| 3 | $CF_3(CF)_8CH_2CH_2C(O)O(CH_2)_{10}CH_3$ | — | 4.6 |
| 4 | $CF_3(CF_2)_{12}CH_2CH_2C(O)O(CH_2)_8CH_3$ | — | 7.1 |
| 5 | $CF_3(CF_2)_8CH_2CH_2C(O)ONa$ | — | 17.3 |
| 6 | $CF_3(CF_2)_{12}CH_2CH_2C(O)ONa$ | — | 13.8 |
| 7 | $CF_3(CF_2)_8CH_2CH_2SO_3Na$ | Zonyl TBS[4] | 9.2 |
| 8 | $CF_3(CF_2)_{12}CH_2CH_2SO_3Na$ | | 5.7 |
| 9 | $HO(CH_2CH_2O)_3(CH(CH_3)CH_2O)_{30}$-$(CH_2CH_2O)_3H$ | Pluronic L61[5] | 3.0 |
| 10 | $HO(CH_2CH_2O)_2(CH(CH_3)CH_2O)_{16}$-$(CH_2CH_2O)_2H$ | Pluronic L31[6] | 4.5 |
| 11 | $HO(CH_2CH_2O)_8(CH(CH_3)CH_2O)_{30}$-$(CH_2CH_2O)_8H$ | Pluronic L62[7] | 7.0 |
| 12 | $(CH_2CH_2O)_7(CH(CH_3)CH_2O)_{21}$-$(CH_2CH_2O)_7H$ | Pluronic L43[8] | 12.0 |
| 13 | $HO(CH(CH_3)CH_2O)_{12}(CH_2CH_2O)_9$-$(CH_2CH(CH_3)O)_{12}H$ | Pluronic 17R2[9] | 8.0 |
| 14 | Polyethylene glycol surfactant (PEG) | Akyporox NP 1200 V[10] | 19.2 |
| 15 | PEG 100- Laurate | | 19.1 |
| 16 | Linear alkylene benzene sulfonate | | 20.0 |
| 17 | Sodium lauryl sulfate | | 40.0 |
| 18 | Sodium Cocoyl Sarcosinate | | 27.0 |

[1]Attwood, D.; Florence, A. T. "Surfactant Systems: Their chemistry, pharmacy and biology.", Chapman and Hall, NY, 1983, pp. 472–474.
[2–4]Supplied by Dupont.
[5–9]Supplied by BASF.
[10]Supplied by Chem-Y GmbH of Germany.

The conventional surfactants (Nos. 14–18) exhibit an HLB value of greater than 15 and are not effective as dry cleaning components in the invention.

EXAMPLE 2

Carbon dioxide was used as a cleaning medium to dry clean stains on rayon fabric. The stained fabrics were prepared by taking two by three inch cloths and applying stains directly to the cloths. The cloths were then allowed to dry.

The stained cloths were then placed in a 300 ml autoclave having a carbon dioxide supply and extraction system. Each stained cloth was hung from the bottom of the overhead stirrer of the autoclave using a copper wire to promote good agitation during washing and rinsing. After placing the cloth in the autoclave with any surfactant and/or modifier and sealing it, carbon dioxide at tank pressure (approx 830 psi) was allowed into the system by opening a valve between the tank and the autoclave. The autoclave was cooled to the desired temperature by using a cooling solution that was pumped through an internal condenser by a circulating pump. When the desired temperature and pressure were reached in the autoclave, the valve was closed and the stirrer was turned on for a wash cycle of 15 minutes. At the completion of the wash cycle, the valve to the tank and the valve to the extractor were opened, and fresh carbon dioxide (20 cu ft) was allowed to flow through the system to mimic a rinse cycle. The pressure of carbon dioxide was then released to atmospheric pressure and the cleaned cloth was removed from the autoclave. To measure the extent of cleaning, the cloths were placed on a Reflectometer$^R$ supplied by Colorguard. The R scale, which measure darkness from black to white, was used to determine stain removal. Cleaning results were reported as the percent stain removal according to the following calculation:

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100\%$$

EXAMPLE 3

The hydrophilic stain grape juice was drycleaned using carbon dioxide alone, and using carbon dioxide in conjunction with water and a polydimethylsiloxane surfactant according to the invention. Two inch by three inch rayon cloths were cut and stained with grape juice concentrate which was diluted 1:10 with water. The stains were allowed to dry and were approximately 2% by weight after drying.

The cloths were then cleaned as described in Example 2, using carbon dioxide alone as a control, and carbon dioxide with water and a polydimethylsiloxane surfactant modified with an ethylene oxide chain of ten repeat units, at two temperature levels of approximately 10° C. and 15° C. and a pressure of 700–800 psi.

The cleaning results for grape juice stained rayon cleaned with carbon dioxide are reported below.

TABLE 1

Drycleaning of Grape Juice Stained Rayon in Carbon Dioxide

| Stain | Cloth | Surfactant | Modifier | Wash Temp. | Rinse Temp. | % Clean |
|---|---|---|---|---|---|---|
| grape juice | rayon | none | none | 7–8° C. | 9–10° C. | −0.4 |
| grape juice | rayon | none | none | 15° C. | 15–17° C. | −0.2 |
| grape juice | rayon | 0.2 g $EO_{10}$ $MD_{12.7}D^{-}M$[1] | 0.5 g water | 15–16° C. | 16–18° C. | 52 |
| grape juice | rayon | 0.2 g $EO_{10}$ $MD_{12.7}D^{-}M$ | 0.5 g water | 8–9° C. | 10–11° C. | 36 |

[1]A copolymer of polydimethylsiloxane having a molecular weight of 1660 and 6.4% of its siloxyl groups substituted with a 100% ethylene oxide chain. Prepared as described in Hardman, B., "Silicones" The Encyclopedia of Polymer Science and Engineering, Vol. 15, 2nd ed., J. Wiley & Sons, New York, NY (1989).

The results in Table 1 show that drycleaning in densified carbon dioxide under these conditions is effective at removing grape juice stains from rayon when a surfactant and water are used in combination with the carbon dioxide,

EXAMPLE 4

The hydrophobic stain red candle wax was drycleaned using carbon dioxide alone, and using carbon dioxide in conjunction with surfactants according to the invention. Two inch by three inch rayon cloths were stained with approximately 40 drops of melted red candle wax which were applied in a circular pattern. The cloths were then allowed to dry and the excess wax layer was scraped from the top and bottom of each stain so that only a flat, waxy colored stain remained.

The cloths were then cleaned as described in Example 2, using carbon dioxide alone as a control, and carbon dioxide and surfactants such as Krytox™, a fluorinated polyether carboxylate supplied by DuPont, Inc. of Delaware, which was converted to its ammonium salt; and a polydimethylsiloxane surfactant modified with a $C_{12}$ alkylene chain, abbreviated as $MD_{15.3}D^{*}_{1.5}M\ C_{12}$. The experiments were conducted at a pressure of 700–800 psi and at two temperature levels, about 10° C. and about 15° C.

TABLE 2

Drycleaning of Red Candle Wax Stained Rayon in Carbon Dioxide

| Stain | Cloth | Surfactant | Wash Temp. | Rinse Temp. | % Clean |
|---|---|---|---|---|---|
| red candle wax | rayon | none | 9–10° C. | 10–12° C. | 41 |
| red candle wax | rayon | none | 16–17° C. | 16–17° C. | 52 |
| red candle wax | rayon | $MD_{15.3}D^{-}_{1.5}MC_{12}$[2] | 9° C. | 10–11° C. | 79 |
| red candle wax | rayon | Krytox ™[3] | 15° C. | 16–17° C. | 81 |
| red candle wax | rayon | Krytox ™ | 9° C. | 10–12° C. | 80 |

[2]A copolymer of polydimethylsiloxane and a lauric substituted hydrocarbon silicon monomer having a molecular weight of 1,500 and prepared as described in Hardman, Supra.
[3]A fluorinated polyether ammonium carboxylate surfactant supplied in the acid form by DuPont, Inc. of Delaware.

[2]A copolymer of polydimethylsiloxane and a lauric substituted hydrocarbon silicon monomer having a molecular weight of 1,500 and prepared as described in Hardman. Supra.
[3]A fluorinated polyether ammonium carboxylate surfactant supplied in the acid form by DuPont, Inc. of Delaware.

The results in Table 2 show that the addition of a surfactant to the system provides greatly improved cleaning of the red candle wax stain over carbon dioxide alone.

EXAMPLE 5

The hydrophilic stain grape juice was drycleaned using carbon dioxide alone, and using carbon dioxide in conjunction with water and a polydimethylsiloxane surfactant according to the invention. Two inch by three inch rayon cloths were cut and stained with grape juice concentrate which was diluted 1:10 with water. The stains were allowed to dry and were approximately 7% by weight after drying.

The cloths were then cleaned as described in Example 2, using carbon dioxide alone as a control, with water only, with a polydimethylsiloxane surfactant modified with an ethylene oxide chain of ten units, and with the surfactant plus water, at a wash temperature of about 6°–9° C. and a rinse temperature of about 9°–12° C. The pressure ranged from about 500 to about 800 psi.

TABLE 3

Drycleaning of Grape Juice Stained Rayon in Carbon Dioxide

| Stain | Cloth | Surfactant | Modifier | Wash Temp. | Rinse Temp. | % Clean |
|---|---|---|---|---|---|---|
| grape juice | rayon | none | none | 7–8° C. | 9–10° C. | −0.4 |
| grape juice | rayon | none | 0.5 g water | 7–8° C. | 9–11° C. | 11 |
| grape juice | rayon | 0.2 g $EO_{10}$ $MD_{12.7}D^{-}M$[4] | none | 6–8° C. | 10–12° C. | 48 |
| grape juice | rayon | 0.2 g $EO_{10}$ $MD_{12.7}D^{-}M$ | 0.5 g water | 9° C. | 10–11° C. | 36 |
| grape juice | rayon | 0.2 g $EO_{10}$ $MD_{20}D^{-}_{2}M$[5] | none | 7–8° C. | 10–11° C. | 48 |
| grape juice | rayon | 0.2 g $EO_{10}$ $MD_{20}D^{-}_{2}M$ | 0.5 g water | 8–9° C. | 8–10° C. | 42 |

[4]A polydimethylsiloxane having a molecular weight of 1660 and 6.4% of its siloxyl groups substituted with a 100% ethylene oxide chain. Synthesized according to Hardman, Supra.
[5]A polydimethylsiloxane having a molecular weight of 2760 and 8.3% of its siloxyl groups substituted with a 100% ethylene oxide chain. Synthesized according to Hardman, Supra.

[4]A polydimethylsiloxane having a molecular weight of 1660 and 6.4% of its siloxyl groups substituted with a 100% ethylene oxide chain. Synthesized according to Hardman, Supra.
[5]A polydimethylsiloxane having a molecular weight of 2760 and 8.3% of its siloxyl groups substituted with a 100% ethylene oxide chain. Synthesized according to Hardman, Supra.

The drycleaning results show that the system is effective at removing the grape juice stain from the rayon over carbon dioxide alone, and that the addition of surfactant, and surfactant plus water provide greater stain removal than the addition of only water to the system.

EXAMPLE 6

The hydrophilic stain grape juice was drycleaned using carbon dioxide alone, and using carbon dioxide in conjunction with water and a polydimethylsiloxane surfactant according to the invention. Two inch by three inch rayon cloths were cut and stained with grape juice concentrate which was diluted 1:10 with water. The stains were allowed to dry and were approximately 7% by weight after drying.

The cloths were then cleaned as described in Example 2, using carbon dioxide alone as a control, with water only, with a polydimethylsiloxane surfactant modified with an ethylene oxide/propylene oxide chain, and with the surfactant plus water, at a wash temperature of about 6°–10° C. and a rinse temperature of about 9°–15° C. The pressure ranged from about 700 to about 800 psi.

TABLE 4

Drycleaning of Grape Juice Stained Rayon in Carbon Dioxide

| Stain | Cloth | Surfactant | Modifier | Wash Temp. | Rinse Temp. | % Clean |
|---|---|---|---|---|---|---|
| grape juice | rayon | none | none | 7–8° C. | 9–10° C. | −0.4 |
| grape juice | rayon | none | 0.5 g water | 7–8° C. | 9–11° C. | 11 |
| grape juice | rayon | ABIL 88184[6] | none | 9–10° C. | 9–10° C. | 33 |
| grape juice | rayon | ABIL 88184 | 0.5 g water | 6–9° C. | 10–15° C. | 25 |

[6]A polydimethylsiloxane surfactant having a molecular weight of 13,200 and 5% of its siloxyl groups substituted with a 86/14 ethylene oxide/propylene oxide chain supplied by Goldschmidt of Virginia.

[6]A polydimethylsiloxane surfactant having a molecular weight of 13,200 and 5% of its siloxyl groups substituted with a 86/14 ethylene oxide/propylene oxide chain supplied by Goldschmidt of Virginia.

The drycleaning results show that the system is effective at removing the grape juice stain from the rayon over carbon dioxide alone, and that the addition of surfactant, and surfactant plus water provide greater stain removal than the addition of only water to the system.

We claim:

1. A method of dry cleaning stains from fabrics comprising:

contacting stained fabrics with a dry cleaning system comprising i) a dry cleaning amount of densified carbon dioxide in a temperature range of from about −78.5° C. to less than about 20° C. and a pressure of about 14.7 to about 10,000 psi;

ii) 0.001% to 10% by wt. of a surfactant compound which is soluble in the densified carbon dioxide and is selected from the group consisting of (a) compounds of formula I $$\{(CX_3(CX_2)_a(CH_2)_b)_c(A)_d-\{(L)_e-(A')_f\}_n-(L')_g\}_oZ^2(G)_h \quad (I)$$

wherein

X is F, Cl, Br, I or mixtures thereof;

a is 1–30, b is 0–5, c is 1–5,

A and A' are each independently a linking moiety representing an ester, a keto, an ether, a thio, an amido, an amino, a $C_{1-4}$ fluoroalkenylene, a $C_{1-4}$ fluoralkenylene, a branched or straight chain polyalkylene oxide, a phosphate, sulfonyl, a sulfate, an ammonium or mixtures thereof;

d is 0 or 1,

L and L' are each independently a $C_{1-30}$ straight chained or branched alkylene or alkenylene or a phenylene which is unsubstituted or substituted or mixtures thereof;

e is 0–3, f is 0 or 1, n is 0–10, g is 0–3;

o is 0–5, $Z^2$ is selected from the group consisting of a hydrogen, a carboxylic acid, a hydroxy, a phosphato, a phosphato ester, a sulfonyl, a sulfonate, a sulfate, a branched or straight-chained polyalkylene oxide, a nitryl, a glyceryl, phenylene unsubstituted or substituted with a $C_{1-30}$ alkylene or alkenylene, a carbohydrate unsubstituted or substituted with a $C_{1-10}$ alkylene or alkenylene and an ammonium;

G is an ion selected from the group consisting of $H^+$, $Na^+$, $Li^+$, $K^+$, $NH_4^+$, $Ca^{+2}$, $Mg^{+2}$, $Cl^-$, $Br^-$, $I^-$, mesylate, and tosylate, and h is 0–3, (b) compounds of formula II $$\{H-[CH(R^4)-CH(R^5)-O]_i(A)_d-\{(L)_e-(A')_f\}_n-(L')_g\}_oZ^2(G)_h \quad (II)$$

wherein $R^4$ and $R^5$ each represent a hydrogen, a $C_{1-5}$ straight chained or branched alkyl or alkyl oxide or mixtures thereof;

i is 1 to 50,

A, A', d, L, L', e, f, n, g, o, $Z^2$, G and h are as defined above, (c) compounds of formula III $$\{(CX_3(XO)_r(T)_s)_c(A)_d-\{(L)_e-(A')_f\}_n(L')_g\}_oZ^2(G)_h \quad (III)$$

wherein

XO is a halogenated alkylene oxide having a $C_{1-6}$ straight or branched halocarbon;

r is 1–30;

T is a straight chained or branched haloalkylene or halophenylene;

s is 0–5;

X, A, A', c, d, L, L'e, f, n, g, o, $Z^2$, G and h are as defined above, (d) compounds of formula IV $$MD_xD^*_yM \quad (IV)$$

wherein M is a trimethylsiloxyl end group, $D_x$ is a dimethylsiloxyl backbone which is $CO_2$-philic and $D^*_y$ is one or more methylsiloxyl groups which are substituted with a $CO_2$-phobic $R^2$ or $R^3$ group or mixtures of $R^2$ and $R^3$ wherein $R^2$ and $R^3$ are each independently defined by the formula $$(CH_2)_{a'}(C_6H_4)_{b'}(A)_d-\{(L)_e-(A')_f\}_n-(L')_gZ^2(G)_h$$

wherein a' is 1–30, b' is 0 or 1, $C_6H_4$ is unsubstituted or substituted with a $C_{1-10}$ alkylene or alkenylene, and A, A', d, L, e, f, n, L', g, $Z^2$, G and h are as defined above, and mixtures of compounds of formula I–IV, (iii) 0 to about 10% by volume of a modifier, (iv) 0 to about 5% by wt. of an organic peracid, (v) 0 to 10% by wt. of an enzyme solution;

to dry cleaning stains from the stained fabrics.

2. A method according to claim 1, wherein the modifier is present in an amount of from about 0.001 to about to about 5 wt. % and is selected from the group consisting of water, acetone, glycol, acetonitrile, a $C_{1-10}$ alcohol, a $C_{5-15}$ hydrocarbon and mixtures thereof.

3. A method according to claim 1, wherein the compounds of formulas I–IV are those wherein A and A' are each independently an ester, an ether, a thio, a branched or straight chain polyalkylene oxide, an amido, an ammonium or mixtures thereof; $Z^2$ is a hydrogen, a carboxylic acid, a hydroxyl, a phosphato, a sulfonyl, a sulfate, an ammonium, a branched or straight chain polyalkylene oxide or an unsubstituted carbohydrate; and G is $H^+$, $L^+$, $Na^+$ $NH_4^+$, $Cl^-$, $Br^-$ or tosylate.

4. A method according to claim 3, wherein the compounds of formulas I–IV are those wherein A and A' are each an ester, an ether, an amido, a branched or straight chain polyalkylene oxide and mixtures thereof; L and L' are each independently a $C_{1-20}$ alkylene or unsubstituted phenylene, $Z^2$ is a hydrogen, phosphato, a sulfonyl, a carboxylic acid, a sulfate or a branched or straight chain polyalkylene oxide; and G is $H^+$, $Na^+$ or $NH_4^+$.

5. A method according to claim 1 wherein the $D_x$ and $D^*_y$ of formula IV are present in a molar ratio of $D_x$; $D^*_y$ of greater than 1:1.

6. The method according to claim 5, wherein the compounds of formula IV have a molecular weight in the range of from 100 to 100,000.

7. The method according to claim 6, wherein the molecular weight is from 200 to 50,000.

8. The method according to claim 1, wherein the organic peracid is selected from the group consisting of N,N-phthaloylaminoperoxycaproic acid (PAP) and N,N'-terephthaloyl-di(6-aminoperoxycaproic acid) (TPCAP), a haloperbenzoic acid and peracetic acid.

9. The method according to claim 1, wherein the enzyme of said enzyme solution is selected from the group consisting of a protease, an amylase, a lipase, an oxidase and mixtures thereof.

10. A method according to claim 1, wherein the densified carbon dioxide is in a liquid phase having a pressure of about 75.1 psi to about 8000 psi and a temperature of about −56.5° C. to less than about 20° C.

* * * * *